US006966666B2

(12) United States Patent
Liu

(10) Patent No.: US 6,966,666 B2
(45) Date of Patent: Nov. 22, 2005

(54) BATTERY-POWERED ILLUMINATED ICE CUBE

(75) Inventor: Cheng Feng Liu, Shenzhen (CN)

(73) Assignee: Cool Cubes, Inc., Plymouth, MN (US)

( * ) Notice: Subject to any disclaimer, the term of this patent is extended or adjusted under 35 U.S.C. 154(b) by 0 days.

(21) Appl. No.: 10/632,143

(22) Filed: Jul. 31, 2003

(65) Prior Publication Data

US 2004/0208001 A1 Oct. 21, 2004

(30) Foreign Application Priority Data

Apr. 15, 2003 (CN) ..... 03244998 U

(51) Int. Cl.[7] ..... F21V 33/00
(52) U.S. Cl. ..... 362/101; 362/329; 446/485
(58) Field of Search ..... 362/157, 189, 362/206, 208, 363, 485, 101, 102, 116, 158, 205, 362, 800; 446/485, 484, 267, 219

(56) References Cited

U.S. PATENT DOCUMENTS

| | | | | | |
|---|---|---|---|---|---|
| 1,107,645 | A | | 8/1914 | Benedict | |
| 3,818,208 | A | * | 6/1974 | Kahl | 340/331 |
| 4,409,644 | A | | 10/1983 | Axton et al. | 362/200 |
| 5,070,437 | A | * | 12/1991 | Roberts, Sr. | 362/158 |
| 5,463,537 | A | | 10/1995 | Trattner et al. | 362/103 |
| 5,697,182 | A | | 12/1997 | Rodgers | 43/17.1 |
| 5,860,724 | A | * | 1/1999 | Cheng | 362/34 |
| 5,903,212 | A | * | 5/1999 | Rodgers | 340/309.8 |
| 6,416,198 | B1 | * | 7/2002 | Vanderschuit | 362/158 |
| 6,669,352 | B2 | * | 12/2003 | McKinney | 362/158 |
| 6,793,362 | B2 | * | 9/2004 | Tai | 362/101 |
| 6,824,289 | B2 | | 11/2004 | Vanderschuit | 362/101 |
| 6,874,909 | B2 | | 4/2005 | Vanderschuit | 362/232 |
| 2003/0026088 | A1 | | 2/2003 | Vanderschuit | 362/101 |

* cited by examiner

*Primary Examiner*—John Anthony Ward
*Assistant Examiner*—Ismael Negron
(74) *Attorney, Agent, or Firm*—Fredrikson & Byron, P.A.

(57) ABSTRACT

An illuminable electronic ice cube comprising an outer casing, inner unit, LED, circuit board, battery, bottom lid, and battery cover lid. The outer casing has a natural ice cube shape with ripple-shaped sides. The inner unit is fitted in the outer casing and comprises a base, a raised support and an-illuminable light cylinder fixed on the raised support. A chamber in the inner unit runs through the base, raised support and light cylinder. The LED is fitted in the light cylinder and the circuit board is under the LED, and the battery is under the circuit board. The bottom lid is at the bottom of the outer casing and has a push-button switch and a hole matching the battery cover lid. When the battery runs out, the battery cover lid is turned to separate it from the bottom lid, so a new battery can be installed.

19 Claims, 4 Drawing Sheets

BATTERY-POWERED ILLUMINATED ICE CUBE

FIELD OF THE INVENTION

This invention involves an illuminable device, especially an illuminable electronic ice cube.

BACKGROUND OF THE INVENTION

Often at party or festival, a festive atmosphere is desirable, such as lighting up candles, or illuminated color lamps. Or sometimes people put ice cube to wine glass, this can have decorative effect as well as keep wine chilled. But using natural ice cube is not low cost and the decorative effect is limited. So there is a prior design of an illuminable ice cube as shown in FIG. 1. The outer casing 1' resembles an ice cube with ripple-shaped sides. The inner liner 2' is placed in the outer casing. The LED is fitted in the inner liner, and the battery connects to the LED through the switch and the integrated circuit IC. Even though this illuminable ice cube can emit multi-color light and be used as decoration repeatedly, but because after the inner liner is installed in the outer casing, the bottom lid 3' is high-frequency welded to the outer casing. So when the battery runs out, it can no longer illuminate. This is pretty wasteful.

STRUCTURE OF THE INVENTION

The purpose of this invention is to provide an illuminable electronic ice cube that is a replacement of natural ice cube with replaceable the battery.

To achieve the said purpose, this invention uses the following implementation: An electronic illuminable ice cube, it comprises outer casing, inner unit, LED, circuit board, battery, bottom lid, battery cover lid. The outer casing resembles a natural ice cube in shape. The sides are of ripple shape. The inner unit is fitted inside the outer casing. The inner unit comprises a base, a raised support, and an illuminated light cylinder. The illuminated light cylinder in placed on the said raised support. The upper of the inner unit has a chamber, and the chamber runs through the base, the raised support and the illuminated light cylinder. The LED seats into the chamber of the illuminated light cylinder. The circuit board is under the illuminable LED inside the light chamber, the battery is under the circuit board inside the light chamber; The bottom lid is at the bottom of the outer casing, it has a push-button switch and a hole matching the battery cover lid.

The said battery cover lid is a round slice, there is an arc-shaped groove on the back and a set of arc shaped locking teeth on the front. The cross-section of the locking tooth is upside down L shape. The hole on the bottom lid is a bore hole with a set of protruding locking teeth matching the ones on the cover lid.

The battery cover lid has three arc shaped raised locking teeth on the front that are arranged symmetrically. The hole on the cover lid also has three protruding locking teeth.

With the said structure when the battery runs out, the battery cover lid is removable and can be opened by inserting a coin to the arc-shaped groove and turning the coin. The will cause the upside down L-shaped locking teeth to turn away from the locking teeth on the hole of the bottom lid, and the old battery can be replaced. Then turn the coin to lock the battery cover lid. This invention can be used as a replacement of the natural ice cube. It has more decorative effect and saves energy with replaceable battery. In certain embodiments, the light housing is faceted, providing a particularly desirable optical effect.

DETAILED DESCRIPTION OF PREFERRED EMBODIMENTS

Figure 1:
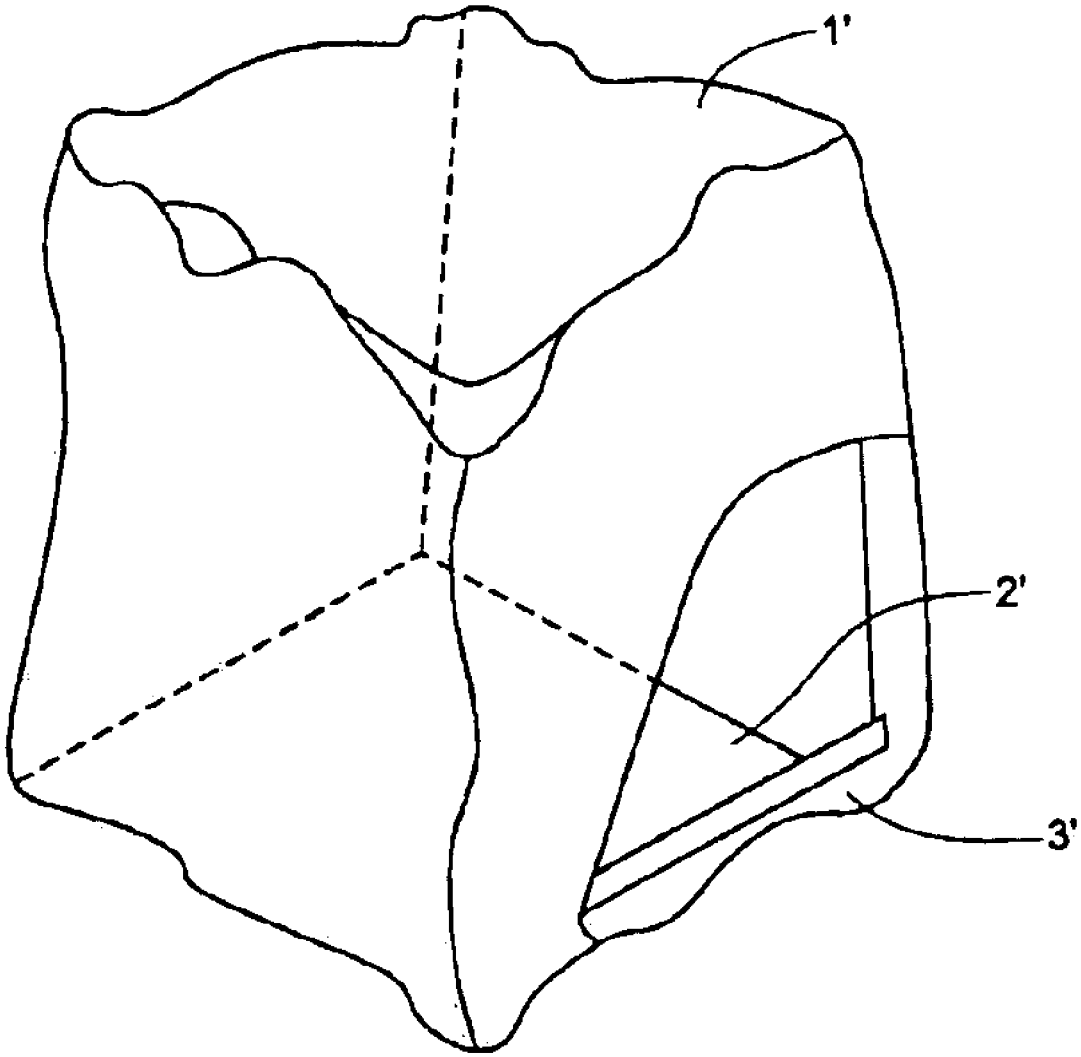
Fig. 1 Prior Art
FIG. 1 is a sketch of an existing design of an illuminable ice cube.
Figure 2:
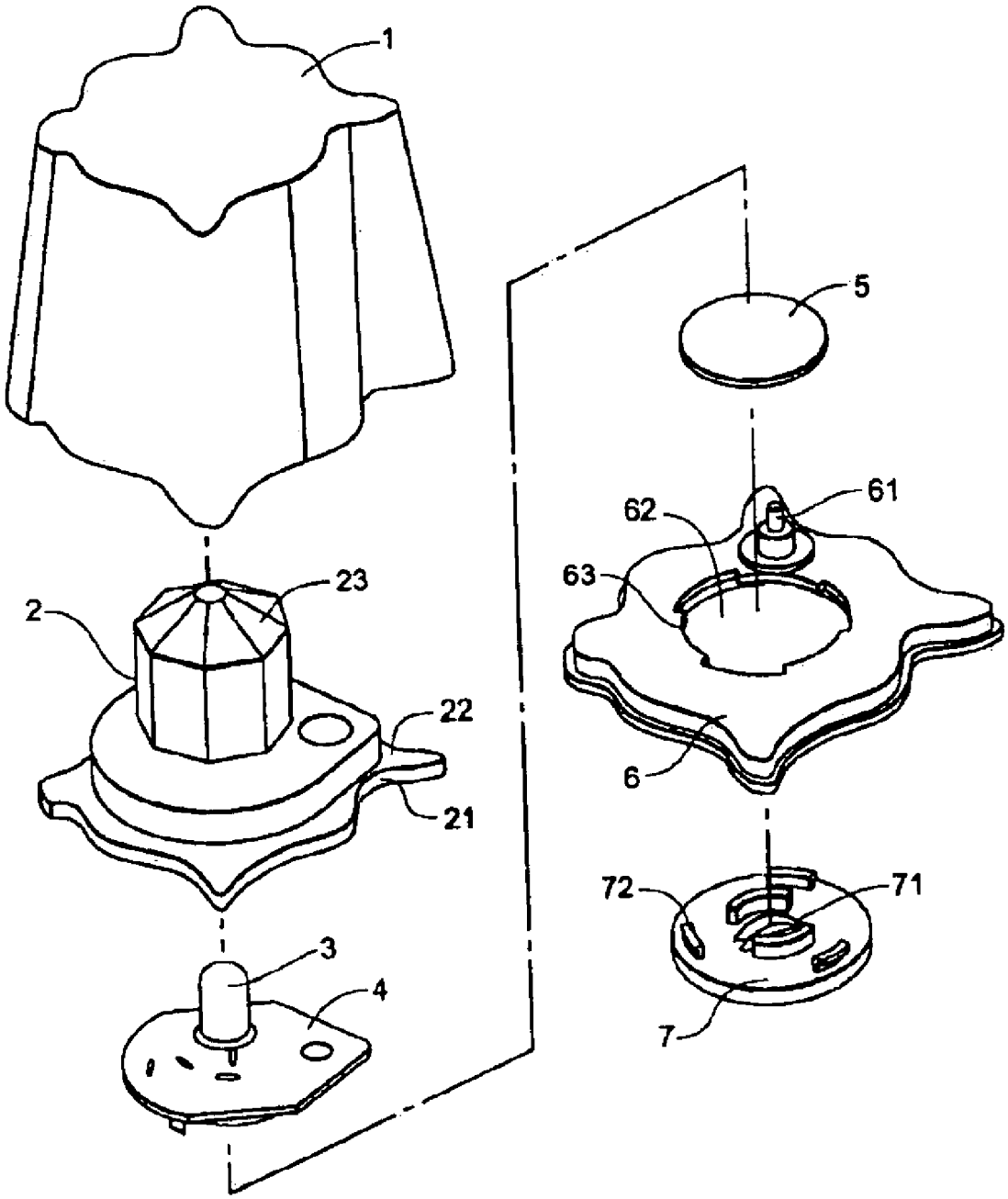
FIG. 2 is the exploded 3-D view of this invention.
Figure 3:
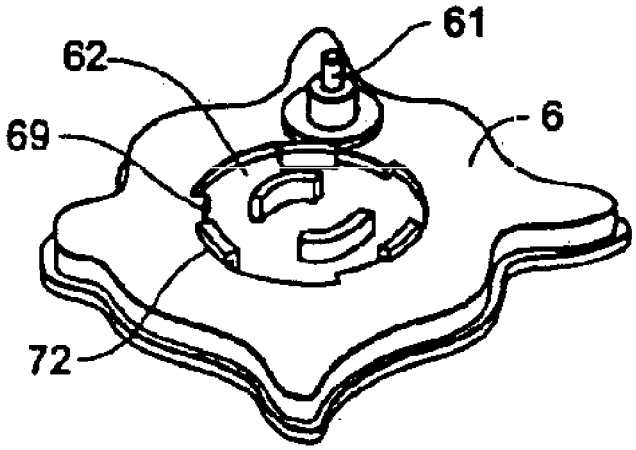
FIG. 3 is the front view of the combined bottom lid and the battery cover lid.
Figure 4:
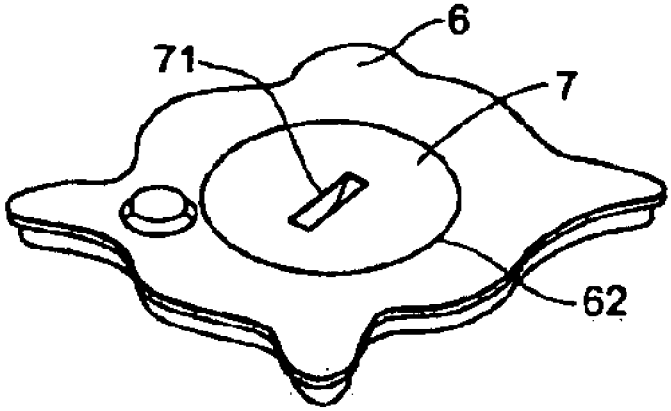
FIG. 4 is the back view of the combined bottom lid and the battery cover lid.
Figure 5:
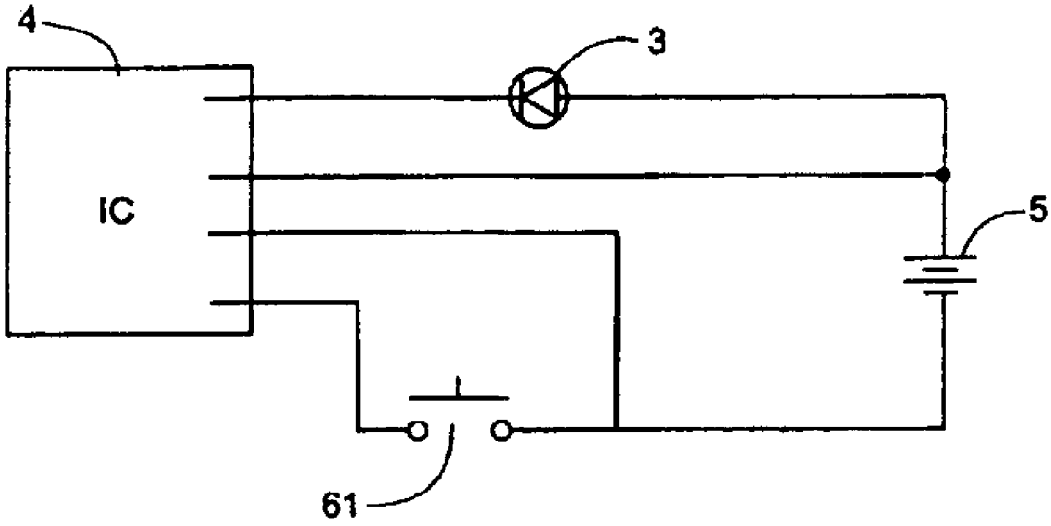
FIG. 5 is the circuit diagram of the invention.

As in FIG. 2 and 3, the illuminable electronic ice cube comprises outer casing 1, inner unit 2, illuminable LED (i.e., a light source) 3, circuit board 4, battery 5, bottom lid 6, and battery cover lid 7. The outer casing preferably is shaped into a natural ice cube shape with ripple-shaped sides. The inner unit is fitted in the outer casing, it comprises the base 21, raised support 22, and a light housing (e.g., a light cylinder) 23. In certain embodiments, the light housing is faceted (e.g., is a faceted cylindrical housing), to give a particularly desirable appearance. The illuminated light cylinder 23 is fixed on the raised support 22. The chamber (not shown) in the upper of the inner unit runs through the base 21, the raised support 22, and the light housing or cylinder 23. The LED is placed in the chamber in the upper portion of the light cylinder 23. The circuit board 4 is placed in the chamber below the LED 3. The battery 5 is installed in the chamber below the circuit board 4. The bottom lid 6 is at the bottom of the outer casing 1. The push-button switch 61 is on the bottom lid 6 (i.e., the lid 6 carries the switch 61). There is a hole (i.e., an opening) 62 on the bottom lid for the battery cover lid (i.e., the battery cover) 7. As shown in FIG. 4, the push-button switch 61 is mounted on the lid 6 at a position offset from (i.e., spaced-apart from/to one side of) the opening 62. In the embodiment of FIG. 4, the opening 62 is located in the center of the lid 6.

The outer casing 1 is preferably a hexahedron made of PERSPEX synthetic resins; the inside is hollow. The inner unit 2 is also made of PERSPEX synthetic resins. Preferably, the light cylinder 23 is a rhombus cylinder. The battery cover lid 7 is a round thin slice with an arc groove 71 on the back. The front of the battery cover lid has three L-shaped locking teeth 72. The hole 62 on the bottom lid 6 has a set of locking teeth 63 matching the ones on the batter cover lid.

When assembling, place illuminable LED 3, circuit board 4 and battery 5 into the chamber 24 of the inner unit 2. Then high frequency weld bottom lid to the outer casing 1. Put the battery cover lid 7 on the hole 62 on bottom lid 6, using a coin or blade turn the battery cover lid 7 to lock the L-shaped teeth 72 on the battery cover lid with the teeth 63 on the hole on the bottom lid.

When the battery 5 runs out, insert a coin or a blade into the arc-shaped groove 71 on the back of the battery cove lid 7, turn battery cover lid 7 so the locking teeth 72 will separate from the locking teeth 63. Replace the battery and lock the battery cover lid.

(1) Polymethyl Methacrylate, Lexiglass, or Acrylic

While there have been described what are believed to be preferred embodiments of the present invention, those skilled in the art will recognize that other and further changes and modifications can be made without departing from the spirit of the invention, and all such changes and modifications should be understood to fall within the scope of the invention.

What is claimed is:

1. An illuminable electronic ice cube, comprising:

an outer casing having a natural ice cube shape with ripple-shaped sides;

an inner unit positioned within the outer casing, the inner unit comprising a base, a raised support, and a light cylinder, the raised support being positioned on the base and the light cylinder being positioned on the raised support to create a chamber therein, the chamber running through the base, raised support and light cylinder, the light cylinder being faceted;

a LED positioned within the chamber;

a circuit board positioned within the chamber and underneath the LED;

a battery positioned within the chamber and underneath the circuit board; and a bottom lid positioned at the bottom of the outer casing, the bottom lid further comprising a push button switch and a hole for receiving a battery cover lid.

2. The illuminable electronic cube of claim 1, wherein the battery cover lid has a round slice configuration having a front and a back, the front including a set of symmetrically placed locking teeth that have a cross-section that is an upsidedown L-shape and the back including an arc-shaped groove and wherein the hole in the bottom lid is a bore hole having a set of locking teeth corresponding to the locking teeth on the front of the battery cover lid.

3. The illuminable electronic cube of claim 1, wherein the bottom lid includes three symmetrical locking teeth and the battery cover lid includes three corresponding locking teeth.

4. An illuminable electronic ice cube, comprising:

an outer casing having an ice cube shape and including a bottom lid, the bottom lid carrying a push-button switch and defining an opening for receiving a battery cover, wherein the push-button switch is mounted on the lid at a position offset from said opening, wherein the bottom lid includes a set of locking teeth and the battery cover includes a set of corresponding locking teeth; and an inner unit adapted for receiving a light source and a battery.

5. The illuminable electronic ice cube of claim 4, wherein said opening is adapted for removably receiving the battery cover.

6. The illuminable electronic ice cube of claim 4, wherein said opening is located in a center of the lid and the push-button switch is spaced-apart from said opening.

7. The illuminable electronic ice cube of claim 4 wherein the locking teeth on the battery cover are L-shaped locking teeth.

8. The illuminable electronic ice cube of claim 4, wherein the bottom lid includes three symmetrical locking teeth and the battery cover lid includes three corresponding locking teeth.

9. The illuminable electronic ice cube of claim 4, wherein the bottom lid comprises a set of locking teeth adjacent said opening, and the battery cover comprises a front and a back, said front having a set of corresponding locking teeth and said back having an arc-shaped groove.

10. The illuminable electronic ice cube of claim 4, wherein the inner unit comprises a light housing in which the light source can be mounted.

11. The illuminable electronic ice cube of claim 4, wherein the light housing is faceted.

12. The illuminable electronic ice cube of claim 4, wherein the light housing is a faceted cylindrical housing.

13. The illuminable electronic ice cube of claim 4, wherein the light housing is a rhombus cylinder.

14. An illuminable electronic ice cube, comprising:

an outer casing having an ice cube shape and including a bottom lid; and an inner unit adapted for carrying a light source and a battery, the inner unit comprising a light housing in which the light source can be mounted, the light housing being faceted.

15. The illuminable electronic ice cube of claim 14, wherein the light housing is a faceted cylindrical housing.

16. The illuminable electronic ice cube of claim 14, wherein the light housing is a rhombus cylinder.

17. The illuminable electronic ice cube of claim 14, wherein the bottom lid carries a push-button switch and defines an opening for receiving a battery cover, wherein the push-button switch is mounted on the lid at a position offset from said opening.

18. An illuminable electronic ice cube, comprising:

an outer casing having an ice cube shape and including a bottom lid, the bottom lid carrying a push-button switch and defining an opening for receiving a removable battery cover, wherein the bottom lid includes a set of locking teeth and the removable battery cover includes a set of corresponding locking teeth, and wherein the push-button switch is mounted on the lid at a position offset from said opening; and an inner unit adapted for receiving a light source and a battery, the inner unit comprising a light housing in which the light source can be mounted, the light housing being faceted.

19. The illuminable electronic ice cube of claim 18, wherein the locking teeth on the battery cover are L-shaped locking teeth.

* * * * *